US010704489B2

(12) United States Patent
Mitsuishi

(10) Patent No.: US 10,704,489 B2
(45) Date of Patent: Jul. 7, 2020

(54) CONTROLLER AND CONTROL METHOD FOR FUEL INJECTION TIMING OF INTERNAL COMBUSTION ENGINE

(71) Applicant: TOYOTA JIDOSHA KABUSHIKI KAISHA, Toyota-shi, Aichi-ken (JP)

(72) Inventor: Yasuhiro Mitsuishi, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 11 days.

(21) Appl. No.: 16/258,779

(22) Filed: Jan. 28, 2019

(65) Prior Publication Data

US 2019/0277218 A1 Sep. 12, 2019

(30) Foreign Application Priority Data

Mar. 6, 2018 (JP) ..... 2018-039677

(51) Int. Cl.

| | |
|---|---|
| ***F02D 41/30*** | (2006.01) |
| ***F02B 7/00*** | (2006.01) |
| ***F02D 41/40*** | (2006.01) |
| ***F02D 41/06*** | (2006.01) |
| *F02B 11/00* | (2006.01) |

(52) U.S. Cl.

CPC ..... *F02D 41/30* (2013.01); *F02B 7/00* (2013.01); *F02D 41/068* (2013.01); *F02D 41/401* (2013.01); *F02B 11/00* (2013.01); *F02D 41/3094* (2013.01); *F02D 2200/021* (2013.01); *F02D 2200/023* (2013.01)

(58) Field of Classification Search

CPC .. F02D 41/30; F02D 2200/023; F02D 41/068; F02B 7/00

See application file for complete search history.

(56) References Cited

U.S. PATENT DOCUMENTS

2011/0307164 A1 12/2011 Arihara et al.
2019/0128212 A1* 5/2019 Polonowski ..... F02D 41/1443

FOREIGN PATENT DOCUMENTS

| | | | |
|---|---|---|---|
| JP | H09-209799 | A | 8/1997 |
| JP | 2010-48178 | A | 3/2010 |
| JP | 2011-256815 | A | 12/2011 |
| JP | 2014-137025 | A | 7/2014 |

* cited by examiner

*Primary Examiner* — Thomas N Moulis
(74) *Attorney, Agent, or Firm* — Oliff PLC

(57) ABSTRACT

A controller executes an advancement process for advancing an injection start timing by a direct injection valve to a larger extent when a coolant temperature that is a temperature of coolant in an internal combustion engine is greater than or equal to a preset temperature than when the coolant temperature is lower than the preset temperature. The advancement process includes a retardation process for setting a smaller advancement amount at the injection start timing when a lubricant temperature that is a temperature of lubricant is lower than a predetermined temperature than when the lubricant temperature is greater than or equal to the predetermined temperature.

8 Claims, 5 Drawing Sheets

$a_{ij} > b_{ij}, c_{ij}, d_{ij}$ $b_{kl} \leqq b_{ko}$ $(l<o)$ $c_{kl} \leqq c_{ko}$ $(l<o)$ $d_{kl} \leqq d_{ko}$ $(l<o)$ $c_{lk} \leqq c_{ok}$ $(l<o)$ $d_{lk} \leqq d_{ok}$ $(l<o)$ $\ulcorner b_{lk}, b_{ok} \notin AR2$ $\Downarrow$ $b_{lk} \leqq b_{ok}$ $(l<o)\lrcorner$ $d_{ij} > c_{ij}$ $\ulcorner b_{pq} \notin AR1$ $\Downarrow$ $b_{pq} < c_{pq}, d_{pq}\lrcorner$

CONTROLLER AND CONTROL METHOD FOR FUEL INJECTION TIMING OF INTERNAL COMBUSTION ENGINE

BACKGROUND

The present disclosure relates to a controller and a control method for controlling the fuel injection timing of an internal combustion engine. The internal combustion engine includes a direct injection valve that injects fuel into a combustion chamber and a lubrication device that discharges lubricant toward the rear surface of a piston.

Japanese Laid-Open Patent Publication No. 2010-48178 describes an example of a controller for limiting the amount of advancement at a timing at which the direct injection device starts injecting fuel when the temperature of coolant (coolant temperature) in the internal combustion engine is less than or equal to a threshold value. Based on the coolant temperature and a lubricant temperature, which is the temperature of lubricant, the controller sets the limit value of advancement.

Further, some lubrication devices discharge lubricant in the internal combustion engine toward the piston.

SUMMARY

The examples of the present disclosure will now be described.

Example 1 a controller for an internal combustion engine is provided. The controller includes a processor that controls a fuel injection timing of the internal combustion engine. The internal combustion engine includes a direct injection valve that injects fuel into a combustion chamber and a lubrication device that discharges lubricant toward a rear surface of a piston. The processor is configured to execute a start timing setting process for setting, through at least one of two processes, an injection start timing of fuel by the direct injection valve. One of the two processes is a process for setting the injection start timing to be more advanced when a rotation speed of a crankshaft of the internal combustion engine is high than when the rotation speed is low, and the other one of the two processes is a process for setting the injection start timing to be more advanced when a load on the internal combustion engine is large than when the load is small. The processor is also configured to execute an injection valve operation process for operating the direct injection valve in order to start injecting fuel from the direct injection valve at the injection start timing. The start timing setting process includes an advancement process for advancing the injection start timing to a larger extent when a coolant temperature that is a temperature of coolant in the internal combustion engine is greater than or equal to a preset temperature than when the coolant temperature is lower than the preset temperature. The advancement process includes a retardation process. In a case in which the coolant temperature is greater than or equal to the preset temperature, the retardation process sets a smaller advancement amount at the injection start timing when a lubricant temperature that is a temperature of the lubricant is lower than a predetermined temperature than when the lubricant temperature is greater than or equal to the predetermined temperature.

In the above configuration, the injection start timing is set to be more advanced when the coolant temperature is greater than or equal to the preset temperature than when the coolant temperature is lower than the preset temperature. This allows the heat of the top surface of the piston to promote fuel atomization. Further, in a case in which the coolant temperature is greater than or equal to the preset temperature, the advancement amount at the injection start timing is set to be smaller when the lubricant temperature is lower than the predetermined temperature than when the lubricant temperature is greater than or equal to the predetermined temperature. Thus, when the lubricant temperature is not sufficiently high and the top surface of the piston is excessively cooled by the lubricant, the injection start timing is limited from being excessively advanced. Accordingly, the particle number (PN) of particulate matter (PM) in exhaust gas can be reduced as compared to when the retardation process based on the lubricant temperature considering that the preset temperature is set to be low.

The inventors considered that when the coolant temperature is high, the injection start timing is advanced so that the heat of the top surface of the piston prompts the atomization of fuel injected from the direct injection valve. However, the inventors found out that the particle number (PN) of particulate matter (PM) in exhaust gas may increase, for example, after the internal combustion engine is cold-started. In addition, the inventors found out that the increase in PN results from the tendency for the increase speed of the lubricant temperature to be slower than the tendency for the increase speed of the coolant temperature after the internal combustion engine is cold-started. That is, when the lubricant temperature is low, PM may be generated when the piston is excessively cooled by the lubricant discharged from the lubrication device and the fuel collects on the top surface of the piston in a liquid state.

In a case in which the advancement amount is limited when the coolant temperature is less than or equal to the threshold value like in the above-described controller, the delay in increase of the lubricant temperature needs to be taken into account. Thus, the threshold value of the coolant temperature may need to be high. The above-described configuration reduces such a possibility.

Example 2

In the controller according to example 1, the processor is configured to execute, when the coolant temperature is lower than or equal to an increase threshold value, a low-temperature fuel-increasing process for increasing an amount of fuel supplied to the combustion chamber in a single combustion cycle to a larger extent when the coolant temperature is low than when the coolant temperature is high. The preset temperature is a value greater than or equal to the increase threshold value.

When the coolant temperature is low, the proportion of fuel to be burned in the fuel supplied into the combustion chamber tends to be low. In the above-described configuration, the low-temperature fuel-increasing process is executed. Thus, even when the temperature of the internal combustion engine is low, the amount of fuel to be burned in the fuel in the combustion chamber can be set to a proper value. Further, in the above-described configuration, the preset temperature is set to be greater than or equal to the increase threshold value. Thus, as compared to when the preset temperature is less than the increase threshold value, for example, PN can be reduced even if the injection start timing is advanced.

Example 3

In the controller according to example 1 or 2, the start timing setting process includes a cold-time process. When the coolant temperature is less than a cold-time threshold value that is less than the preset temperature, the cold-time process advances the injection start timing to a larger extent than when the coolant temperature is greater than or equal to the cold-time threshold value. In a case in which the coolant temperature is greater than or equal to the preset temperature, the advancement process advances the injection start timing to a larger extent, in a range in which the injection start timing is not set to be more advanced than when the coolant temperature is less than the cold-time threshold value, than when the coolant temperature is lower than or equal to the preset temperature and greater than or equal to the cold-time threshold value.

In the above-described configuration, when the coolant temperature is greater than or equal to the cold-time threshold value, the injection start timing is set to be more advanced when the coolant temperature is high than when the coolant temperature is low. This reduces PN. Further, when the coolant temperature is less than the cold-time threshold value, the injection start timing is set to be advanced. This limits the dilution of lubricant that results from the collection of a large amount of fuel on the wall surface of the cylinder.

Example 4

In the controller according to any one of examples 1 to 3, the processor is configured to execute a fuel cut-off process for stopping supplying fuel to the combustion chamber. The retardation process includes a process for setting a small advancement amount at the injection start timing in the same manner as a case in which the coolant temperature is greater than or equal to the preset temperature and the lubricant temperature is lower than the predetermined temperature on condition that the fuel cut-off process has been continued for a predetermined period even if the coolant temperature is greater than or equal to the preset temperature and the lubricant temperature is greater than or equal to the predetermined temperature.

A smaller amount of heat is generated in the combustion chamber when the fuel cut-off process is continued than when the fuel cut-off process is not executed. Thus, when the fuel cut-off process is continued, the top surface of the piston is likely to be cooled. Thus, the fuel may collect on the top surface of the piston in a liquid state, generating particulate matter. In the above-described configuration, the advancement amount at the injection start timing is set to be small on condition that the fuel cut-off process has been continued for the predetermined period. This limits situations in which the fuel cut-off process causes the fuel to collect on the top surface of the piston and particulate matter to be generated.

Example 5

In the controller according to any one of examples 1 to 4, the processor is configured to execute an idling process for controlling the rotation speed of the crankshaft to a target rotation speed on condition that an accelerator operation amount is zero. The retardation process includes a process for setting a small advancement amount at the injection start timing in the same manner as a case in which the coolant temperature is greater than or equal to the preset temperature and the lubricant temperature is lower than the predetermined temperature on condition that the idling process has been continued for a certain period even if the coolant temperature is greater than or equal to the preset temperature and the lubricant temperature is greater than or equal to the predetermined temperature.

A smaller amount of heat is generated in the combustion chamber when the idling process is performed than when the internal combustion engine is running in a region having a larger load than the idling process. Thus, when the idling process is performed, the top surface of the piston is likely to be cooled. Thus, the fuel may collect on the top surface of the piston in a liquid state, generating particulate matter. In the above-described configuration, the advancement amount at the injection start timing is set to be small on condition that the idling process has been continued for the certain period. This limits situations in which the idling process causes the fuel to collect on the top surface of the piston and particulate matter to be generated.

Example 6

The controller according to any one of examples 1 to 5 further includes a storage device that stores map data sets, the map data sets each including the rotation speed and the load as an input variable and including the injection start timing as an output variable. The map data sets include a map data set selected when the coolant temperature is lower than the preset temperature, a map data set selected when the coolant temperature is greater than or equal to the preset temperature and the lubricant temperature is lower than the predetermined temperature, and a map data set selected when the coolant temperature is greater than or equal to the preset temperature and the lubricant temperature is greater than or equal to the predetermined temperature. The start timing setting process includes a process for setting the injection start timing using the map data sets.

In the above-described configuration, a suitable injection start timing is adapted in advance in accordance with the rotation speed and load. Thus, an injection start timing can be set by using a suitable injection start timing adapted in advance in such a manner as a map data set.

Example 7 a control method for an internal combustion engine for executing the processes described in examples 1 to 6 is provided.

Example 8 a non-transitory computer-readable storage medium that stores a program causing a processor to execute the processes described in examples 1 to 7 is provided.

Other aspects and advantages of the present disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the presently preferred embodiments together with the accompanying drawings in which.

DETAILED DESCRIPTION

A fuel injection timing controller for an internal combustion engine according to an embodiment of the present disclosure will now be described with reference to the drawings.

Figure 1:
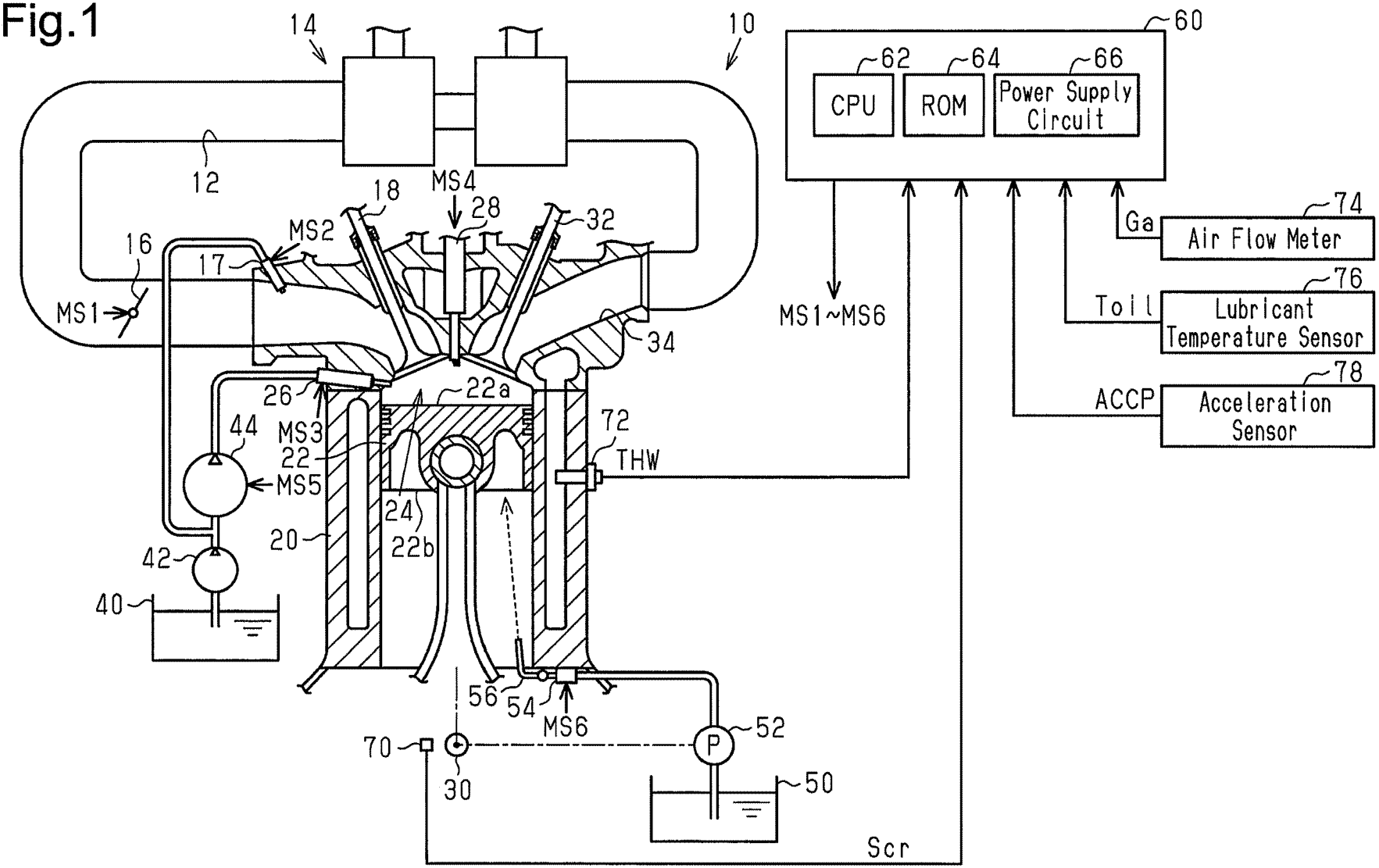
FIG. 1 is a diagram showing a controller and an internal combustion engine according to an embodiment of the present disclosure.

FIG. 1 shows an internal combustion engine 10 provided with an intake passage 12. In the intake passage 12, a throttle valve 16 is provided on the downstream side of a forced induction device 14, and a port injection valve 17 is provided on the downstream side of the throttle valve 16. Air is drawn into the intake passage 12, and fuel is injected from the port injection valve 17. When an intake valve 18 opens, the air and the fuel flow into a combustion chamber 24 defined by a cylinder 20 and a piston 22. In the combustion chamber 24, the fuel injected from the port injection valve 17 and fuel injected by a direct injection valve 26 are mixed with the air flowing from the intake passage 12. The mixture is burned through spark discharge performed by an ignition device 28. Energy generated through the burning is converted by the piston 22 into rotation energy of a crankshaft 30. When an exhaust valve 32 opens, the burned mixture is discharged to an exhaust passage 34 as exhaust gas.

The fuel injected by the port injection valve 17 and the direct injection valve 26 are stored in a fuel tank 40. The fuel in the fuel tank 40 is pumped by a feed pump 42 and supplied to the port injection valve 17 and to a high-pressure pump 44. The high-pressure pump 44 pressurizes the fuel and supplies the pressurized fuel to the direct injection valve 26.

An oil pan 50 stores lubricant. The lubricant stored in the oil pan 50 is drawn in by an engine-driven oil pump 52 driven by the rotational power of the crankshaft 30 and supplied to an injection nozzle 56 by an oil switching valve (OSV) 54. The piston 22 includes a top surface 22*a* opposed to the combustion chamber 24 and a rear surface 22*b* located on the side opposite to the top surface 22*a*. The injection nozzle 56 discharges (injects) the lubricant toward the rear surface 22*b* of the piston 22. The OSV 54 switches on and off the supply of the lubricant to the injection nozzle 56.

The control subject of a controller 60 is the internal combustion engine 10. In order to control, for example, torque and exhaust components serving as the control amounts of the internal combustion engine 10, the controller 60 operates operation units of the internal combustion engine 10 such as the throttle valve 16, the port injection valve 17, the direct injection valve 26, the ignition device 28, the high-pressure pump 44, and the OSV 54. When controlling the control amount, the controller 60 refers to an output signal Scr of a crank angle sensor 70, the temperature of coolant (coolant temperature THW) of the internal combustion engine 10 detected by a coolant temperature sensor 72, an intake air amount Ga detected by an air flow meter 74, and the temperature of lubricant (lubricant temperature Toil) detected by the lubricant temperature sensor 76. Further, the controller 60 refers to the depression amount (accelerator operation amount ACCP) of an accelerator pedal detected by an acceleration sensor 78.

The controller 60 includes a CPU 62 (processor), a ROM 64, and a power supply circuit 66 that supplies power to each section of the controller 60.

Figure 2:
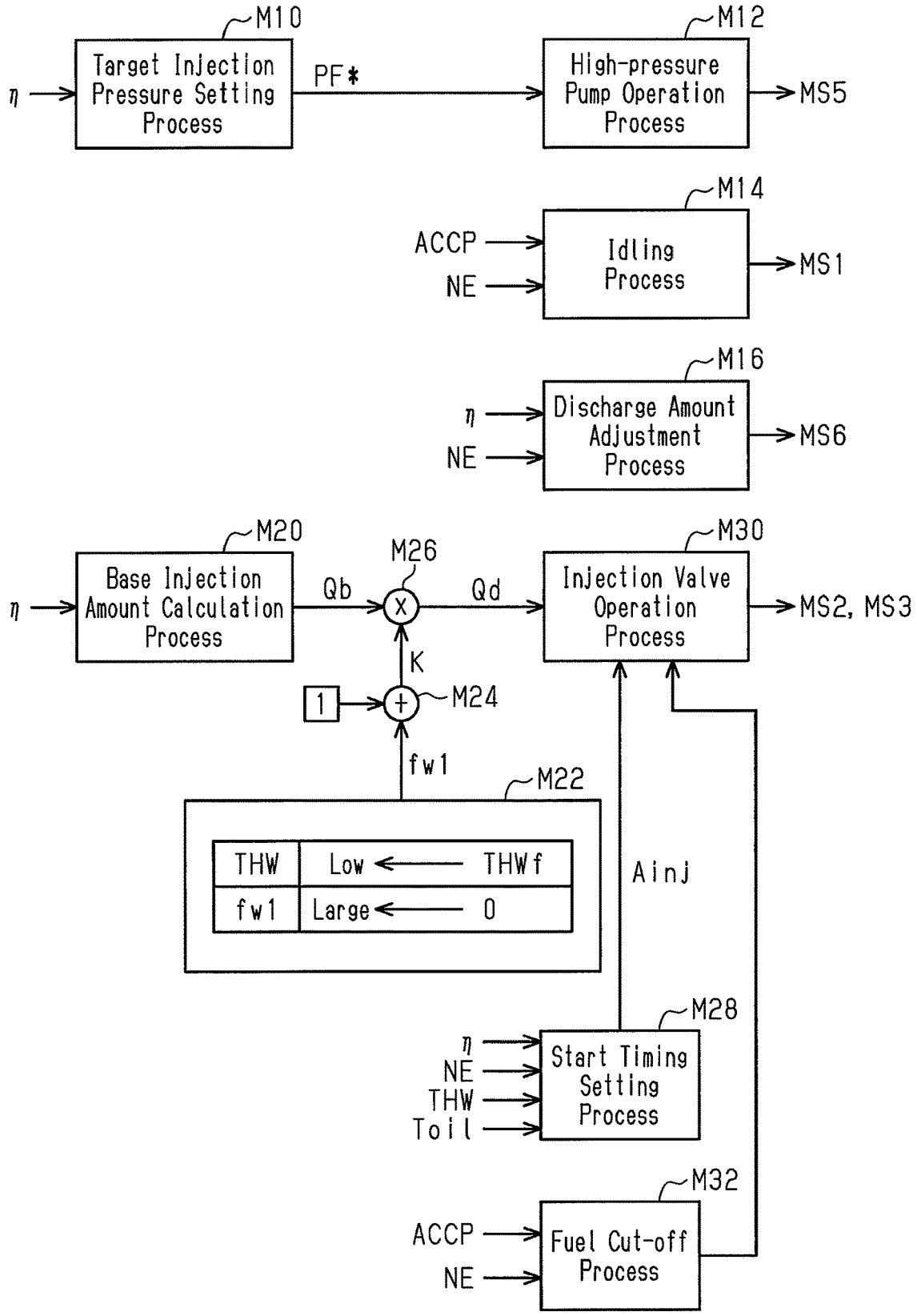
FIG. 2 is a block diagram illustrating some of the processes executed by the controller in the internal combustion engine shown in FIG. 1.

FIG. 2 illustrates some of the processes executed by the controller 60. The processes illustrated in FIG. 2 are implemented when the CPU 62 executes programs stored in the ROM 64.

A target injection pressure setting process M10 is a process for setting, based on a charging efficiency η, a target value (a target injection pressure PF*) of the pressure (injection pressure) of fuel injected from the direct injection valve 26. The target injection pressure setting process M10 includes a process for setting the value of the target injection pressure PF* to be larger when the charging efficiency η is high than when the charging efficiency η is low. The charging efficiency η is a parameter indicating the amount of fresh air filled in the combustion chamber 24. The CPU 62 calculates the charging efficiency η based on a rotation speed NE and the intake air amount Ga of the crankshaft 30. The rotation speed NE is calculated by the CPU 62 based on the output signal Scr of the crank angle sensor 70.

A high-pressure pump operation process M12 is a process for operating the high-pressure pump 44 by outputting an operation signal MS5 to the high-pressure pump 44 in order to control the above-described injection pressure to the target injection pressure PF*.

An idling process M14 is a process for operating the open degree of the throttle valve 16 by outputting an operation signal MS1 to the throttle valve 16 in order to control the rotation speed NE to a target rotation speed on condition that the accelerator operation amount ACCP is zero.

A discharge amount adjustment process M16 includes a process for outputting an operation signal MS6 to the OSV 54 in order to stop discharging lubricant from the injection nozzle 56 to the piston 22 by closing the OSV 54 when the temperature of the piston 22 is lower than or equal to a stop temperature. This process is intended to reduce the load torque applied to the crankshaft 30 and thus reduce the consumption rate of fuel by stopping discharging lubricant when the piston 22 is not seized even if the discharge of lubricant is stopped. The CPU 62 estimates the temperature of the piston 22 based on, for example, the rotation speed NE and the charging efficiency η.

A base injection amount calculation process M20 is a process for calculating a base injection amount Qb, which is the amount of injection for controlling the air-fuel ratio of mixture subject to burning in the combustion chamber 24 to a target air-fuel ratio (for example, stoichiometric air-fuel ratio), based on the charging efficiency η. More specifically, the base injection amount Qb is proportional to the charging efficiency η.

A low-temperature fuel-increasing process M22 is a process for calculating a low-temperature increase ratio fw1, which is a correction ratio for performing feed-forward control to increase the base injection amount Qb, taking into account decreases in the proportion of fuel to be burned in the fuel flowing into the combustion chamber 24 when the temperature of the internal combustion engine 10 is low. More specifically, in the low-temperature fuel-increasing process M22, the low-temperature increase ratio fw1 is calculated to a value greater than 0 when the coolant temperature THW is less than or equal to an increase threshold value THWf (for example, 60° C.), and the low-temperature increase ratio fw1 is set to 0 when the coolant temperature THW is greater than the increase threshold value THWf (for example, 60° C.). Particularly, in a case in which the coolant temperature THW is less than or equal to the increase threshold value THWf, the low-temperature fuel-increasing process M22 sets the low-temperature increase ratio fw1 to be larger when the coolant temperature THW is low than when the coolant temperature THW is high. This process is implemented when the CPU 62 performs map calculation for the low-temperature increase ratio fw1 in a state in which a map data set, in which the coolant temperature THW is an input variable and the low-temperature increase ratio fw1 is an output variable, is stored in the ROM 64 in advance.

A map data set refers to a set of data including the discrete values of input invariables and the values of output variables that respectively correspond to the values of the input variables. In the map calculation, for example, when the value of an input variable coincides with any one of the input variables of a map data set, the value of the corresponding output variable of the map data set is treated as a calculation result. Further, when such a coincidence does not occur, a value obtained through interpolation of the output variables included in the map data set is treated as a calculation result.

A correction coefficient calculation process M24 is a process for calculating a correction coefficient K of the base injection amount Qb by adding 1 to the low-temperature increase ratio fw1. A request injection amount calculation process M26 is a process for calculating a request injection amount Qd by multiplying the base injection amount Qb by the correction coefficient K.

A start timing setting process M28 is a process for calculating an injection start timing Ainj of fuel by the port injection valve 17 and the direct injection valve 26 based on the charging efficiency η, the rotation speed NE, the coolant temperature THW, and the lubricant temperature Toil.

An injection valve operation process M30 is a process for operating the port injection valve 17 and the direct injection valve 26 by outputting an operation signal MS2 to the port injection valve 17 and an operation signal MS3 to the direct injection valve 26. This process is performed in order to inject fuel by the request injection amount Qd by the port injection valve 17 and the direct injection valve 26 by starting injecting fuel at the injection start timing Ainj. In the present embodiment, fuel is injected from the port injection valve 17 during execution of the idling process M14, and fuel is injected from the direct injection valve 26 when other processes are executed.

A fuel cut-off process M32 is a process for stopping injecting fuel on condition that the accelerator operation amount ACCP is zero and the rotation speed NE is greater than or equal to a predetermined speed.

Figure 3:
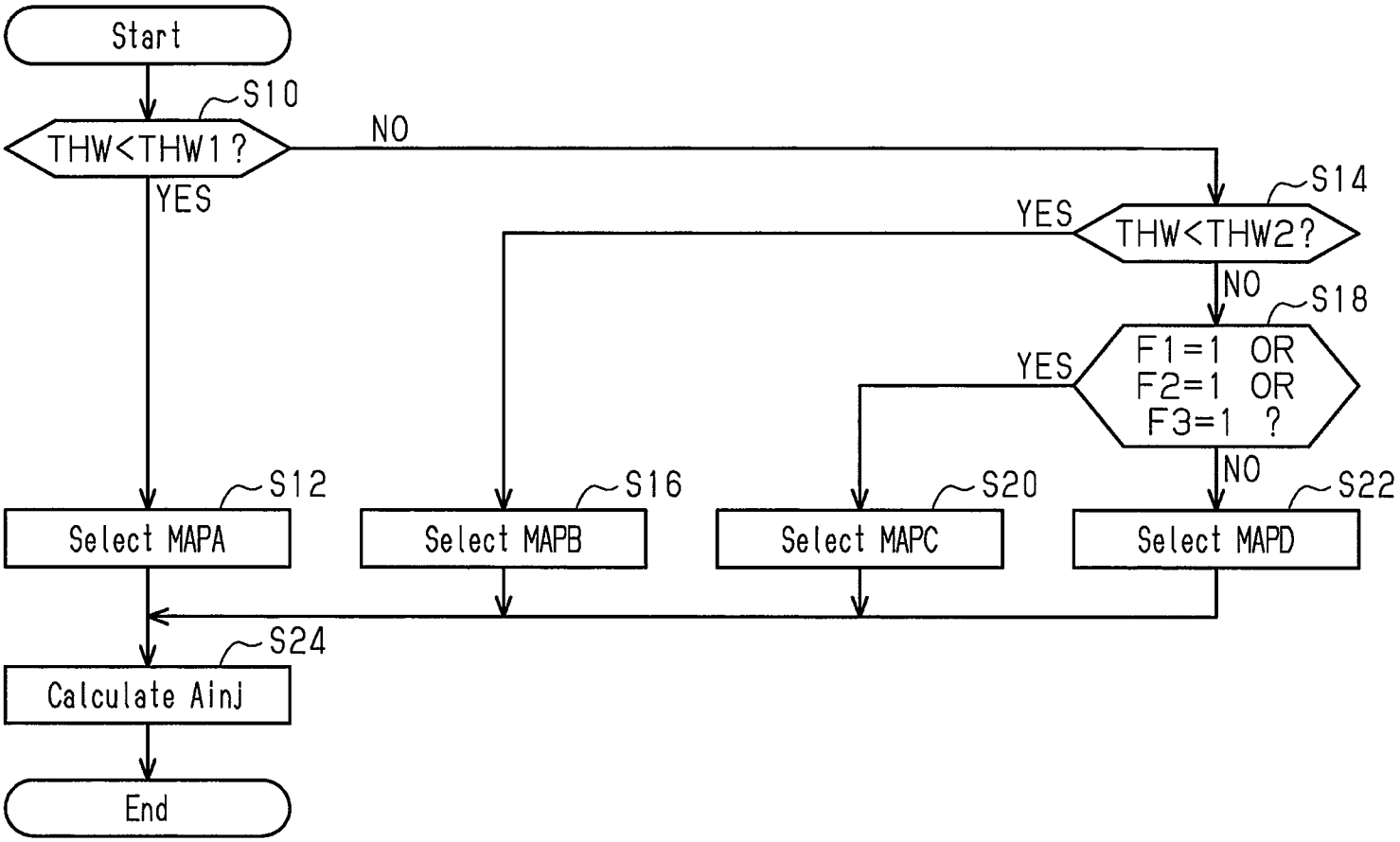
FIG. 3 is a flowchart illustrating the procedures of a start timing setting process in the internal combustion engine shown in FIG. 1.

FIG. 3 illustrates the procedures of processes for setting the injection start timing Ainj for, in particular, a process of injecting fuel by the direct injection valve 26. The processes illustrated in FIG. 3 are implemented when the CPU 62 repeatedly executes programs stored in the ROM 64, for example, in a predetermined cycle on condition that the idling process M14 has not been executed. In the following description, the step number of each process is represented by a number in front of which the character S is given.

In a series of processes illustrated in FIG. 3, the CPU 62 first determines whether or not the coolant temperature THW is less than a cold-time threshold value THW1 (S10). The cold-time threshold value THW1 is smaller than the increase threshold value THWf (for example, 10° C.). When the CPU 62 determines that the coolant temperature THW is less than the cold-time threshold value THW1 (S10: YES), the CPU 62 selects a first map data set, which is shown as MAPA in FIG. 3 (S12). When the CPU 62 determines that the coolant temperature THW is greater than or equal to the cold-time threshold value THW1 (S10: NO), the CPU 62 determines whether or not the coolant temperature THW is lower than a preset temperature THW2, which is greater than the cold-time threshold value THW1 (S14). In the present embodiment, the preset temperature THW2 is greater than the increase threshold value THWf (for example, 80° C.)

When the CPU 62 determines that the coolant temperature THW is lower than the preset temperature THW2 (S14: YES), the CPU 62 selects a second map data set, which is shown as MAPB in FIG. 3 (S16). When the CPU 62 determines that the coolant temperature THW is greater than or equal to the preset temperature THW2 (S14: NO), the CPU 62 determines whether or not the logical disjunction of condition (i) that a first flag F1 is 1, condition (ii) that a second flag F2 is 1, and condition (iii) that a third flag F3 is 1 is true (S18). The first flag F1, the second flag F2, and the third flag F3 will be described later.

When the CPU 62 determines that the logical disjunction of the conditions (i) to (iii) is true (S18: YES), the CPU 62 selects a third map data set, which is shown as MAPC in FIG. 3 (S20). When the CPU 62 determines that the logical disjunction of the conditions (i) to (iii) is false (S18: NO), the CPU 62 selects a fourth map data set, which is shown as MAPD in FIG. 3 (S22).

When the CPU 62 completes any one of the processes of S12, S16, S20, and S22, the CPU 62 performs map calculation for the injection start timing Ainj based on the selected map data (S24). The injection start timing Ainj indicates the amount of advancement from a predetermined crank angle. The injection start timing Ainj has a larger positive value when the amount of advancement is large than when the amount of advancement is small. When the CPU 62 completes the process of S24, the CPU 62 finishes the series of processes illustrated in FIG. 3.

Figure 4:
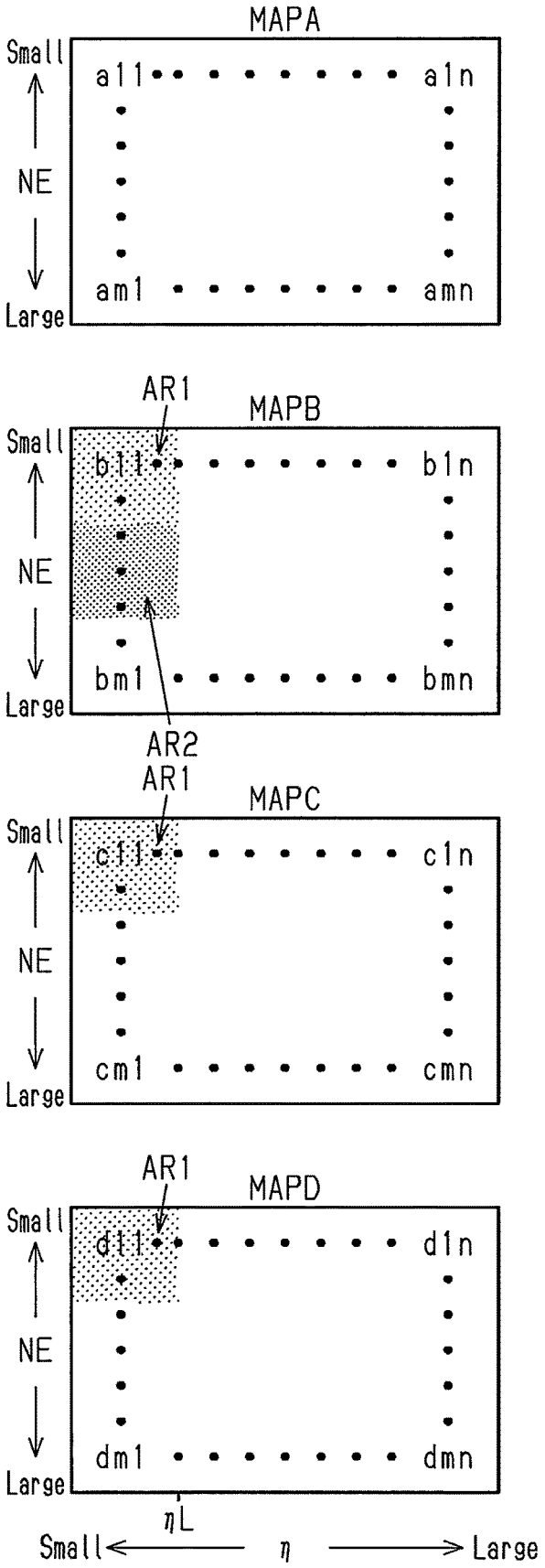
FIG. 4 is a diagram showing map data sets used for setting a start timing in the internal combustion engine shown in FIG. 1.

FIG. 4 illustrates the first map data set (MAPA), the second map data set (MAPB), the third map data set (MAPC), and the fourth map data set (MAPD).

As shown in FIG. 4, the first map data set, the second map data set, the third map data set, and the fourth map data set have the rotation speed NE and the charging efficiency η, which define the operating point of the internal combustion engine 10, as input variables and the injection start timing as output variables aij, bij, cij, dij. In FIG. 4, the map data sets are represented in a matrix. When a variable i that specifies the row of a map data set is large, the map data set corresponds to a larger rotation speed NE than when the variable i is small. When a variable j that specifies the column of a map data set is large, the map data set corresponds to a larger charging efficiency η than when the variable j is small.

As FIG. 4 describes aij>bij, cij, dij, the output variable aij of the first map data set is larger than the corresponding output variable bij of the second map data set, the corresponding output variable cij of the third map data set, and the corresponding output variable dij of the fourth map data set. This is because advancing the injection start timing Ainj is effective to limit dilution of lubricant when the coolant temperature THW is extremely low.

The second map data set, the third map data set, and the fourth map data set are adapted with the intention of reducing the particle number (PN) of particulate matter (PM). PN tends to increase when fuel atomization is poor.

Thus, it is desired that the injection start timing Ainj be set to be advanced in order to promote atomization. However, if the injection start timing Ainj is set to be excessively advanced when the temperature of the top surface 22*a* of the piston 22 is low, the fuel may collect on the top surface 22*a*, thereby increasing PN. Accordingly, in order to set the injection start timing Ainj to be more advanced when the temperature is high than when the temperature is low, the output variable cij of the third map data set and the output variable dij of the fourth map data set are generally set to be larger than the output variable bij of the second map data set and. This is described as bpq<cpq, dpq in FIG. 4 ($1 \le p \le m$, $1 \le q \le n$). In the present embodiment, the output variable bij of the second map data set is exceptionally set to be larger than the output variable cij of the third map data set and the output variable dij of the fourth map data set in a region AR1 in which the rotation speed is low and the charging efficiency $\eta$ is less than or equal to a preset ratio $\eta L$. The preset ratio $\eta L$ is less than or equal to, for example, 50%.

As FIG. 4 describes bkl≤bko, ckl≤cko, dkl≤dko, the values of the output variable bij of the second map data set, the output variable cij of the third map data set, and the output variable dij of the fourth map data set when the charging efficiency $\eta$ is large are greater than or equal to those when the charging efficiency $\eta$ is small ($1 \le k \le m$, $1 \le l < o \le n$). Particularly, in the present embodiment, at a predetermined operating point, the values of the output variables bij, cij, dij when the charging efficiency $\eta$ is large is greater than or equal to those when the charging efficiency $\eta$ is small. Since the base injection amount Qb is larger when the charging efficiency $\eta$ is large than when the charging efficiency $\eta$ is small, such a setting is made to prevent the injection end timing from being set to be excessively retarded.

Further, as FIG. 4 describes clk≤cok, dlk≤dok, the values of the output variable cij of the third map data set and the output variable dij of the fourth map data when the rotation speed NE is high are greater than or equal to those when the rotation speed NE is low ($1 \le l < o \le m$, $1 \le k \le n$). Particularly, in the present embodiment, at a predetermined operating point, the values of the output variables cij, dij are larger when the rotation speed NE is high than when the rotation speed NE is low. This setting is made because the speed of movement of the piston 22 away from the direct injection valve 26 is higher when the rotation speed NE is high than when the rotation speed NE is low. In the present embodiment, excluding a region AR2 having a charging efficiency $\eta$ that is less than or equal to the preset ratio $\eta L$ and having a higher rotation speed than the region AR1, the output variable bij of the second map data when the rotation speed NE is high is greater than or equal to that when the rotation speed NE is low. This is described as blk≤bok in FIG. 4. Particularly, at a predetermined operating point of the regions excluding the region AR2, the output variable bij of the second map data set is larger when the rotation speed NE is high than when the rotation speed NE is low.

When the charging efficiency $\eta$ has a ratio less than or equal to a predetermined ratio that is larger than the preset ratio $\eta L$, in the charging efficiency, the difference between the maximum value and the minimum value of each of the output variable cij of the third map data set and output variable dij of the fourth map data set is larger than the difference between the maximum and the minimum of the output variable bij of the second map data set.

Furthermore, as FIG. 4 describes dij>cij, the output variable dij of the fourth map data has a larger value than the output variable cij of the third map data set. The output variable dij of the fourth map data set is adapted to a value intended to promote atomization by the top surface 22*a* of the piston 22 by causing fuel injected from the direct injection valve 26 to strike the top surface 22*a*. The output variable cij of the third map data set is adapted to a timing at which the collision of fuel of the top surface 22*a* of the piston 22 is less likely to occur than at the timing of the output variable dij of the fourth data.

Figure 5:
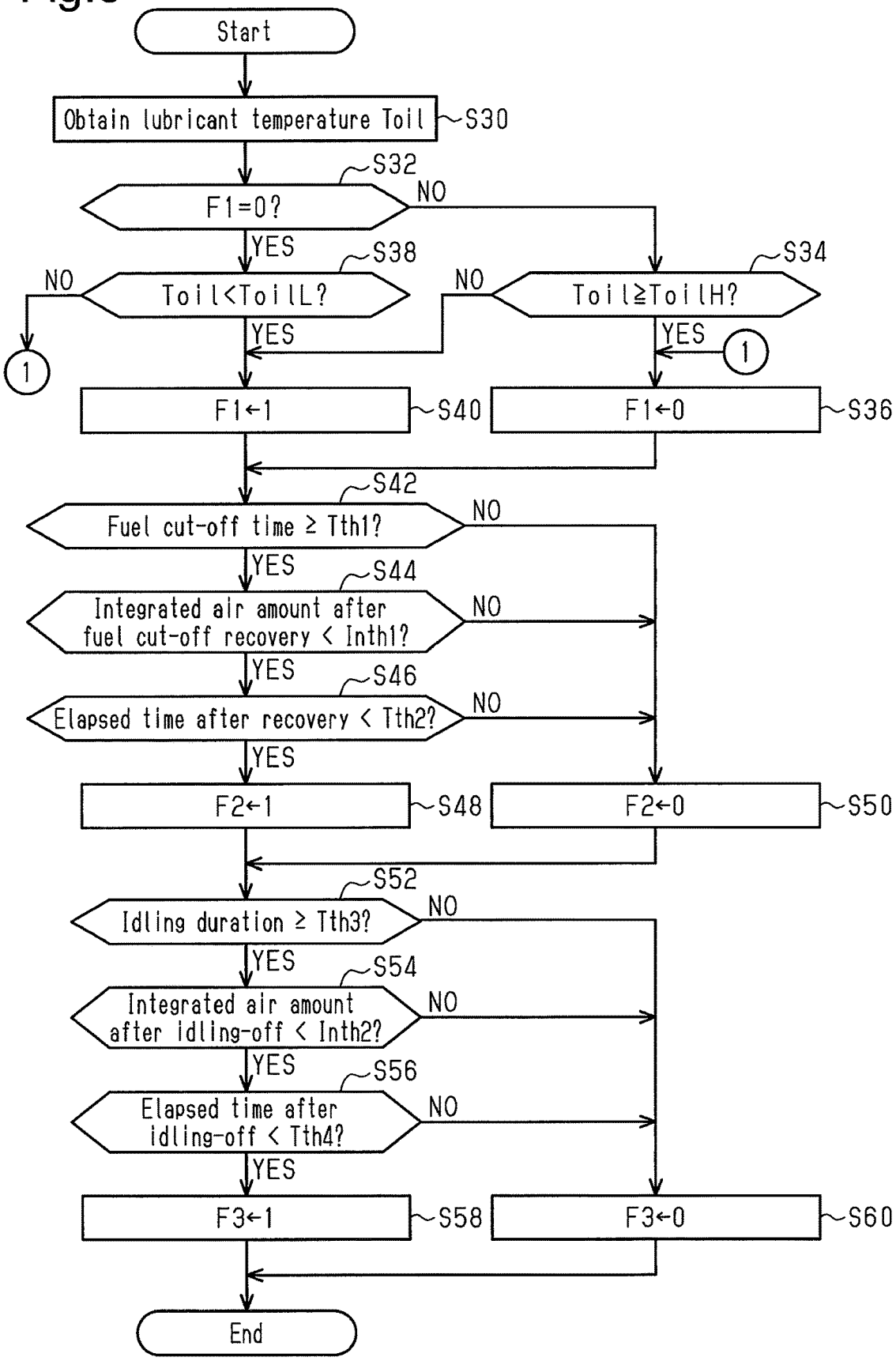
FIG. 5 is a flowchart illustrating the procedures of the start timing setting process in the internal combustion engine shown in FIG. 1.

FIG. 5 illustrates the procedure of processes for setting the first flag F1, the second flag F2, and the third flag F3 in the procedure of the start timing setting process M28. The processes illustrated in FIG. 5 are executed when the CPU 62 repeatedly executes the programs stored in the ROM 64, for example, in a predetermined cycle.

In a series of processes illustrated in FIG. 5, the CPU 62 first obtains the lubricant temperature Toil (S30). Then, the CPU 62 determines whether or not the first flag F1 is 0 (S32). When the lubricant temperature Toil is sufficiently high, the first flag F1 is 0. When the lubricant temperature Toil is not sufficiently high, the first flag F1 is 1. When the lubricant temperature Toil is not sufficiently high, even if the coolant temperature THW is greater than or equal to the preset temperature THW2, the temperature of the top surface 22*a* of the piston 22 may not be sufficiently high. Thus, PN may increase depending on the injection start timing Ainj based on the fourth map data set. Thus, when the lubricant temperature Toil is not sufficiently high, the first flag F1 is set to 1. In the present embodiment, the initial value of the first flag F1 is 1.

When the CPU 62 determines that the first flag is 1 (S32: NO), the CPU 62 determines whether or not the lubricant temperature Toil is greater than or equal to a second predetermined temperature ToilH (S34). The second predetermined temperature ToilH is higher than the preset temperature THW2 (for example, 83° C.). When the CPU 62 determines whether or not the lubricant temperature Toil is greater than or equal to the second predetermined temperature ToilH (S34: YES), the CPU 62 substitutes 0 for the first flag F1 (S36).

When the CPU 62 determines that the first flag is 0 (S32: YES), the CPU 62 determines whether or not the lubricant temperature Toil is lower than a first predetermined temperature ToilL, which is lower than the second predetermined temperature ToilH (S38). When the CPU 62 determines that the lubricant temperature Toil is greater than or equal to the first predetermined temperature ToilL (S38: NO), the CPU 62 proceeds to the process of S36. When the CPU 62 determines that the lubricant temperature Toil is lower than the first predetermined temperature ToilL (S38: YES) and when the CPU 62 makes a negative determination in the process of S34, the CPU 62 sets the first flag F1 to 1 (S40). In this manner, in the present embodiment, when switching the first flag F1 from 0 to 1 and switching the first flag F1 from 1 to 0, the CPU 62 sets different threshold values for the lubricant temperature Toil, which serve as the conditions of the lubricant temperature Toil for switching the first flag F1. This setting is made to limit generation of hunting in which the process of S20 and the process of S22 are frequently switched.

When the CPU 62 completes the process of S36 or S40, the CPU 62 determines whether or not the duration (fuel cut-off time) of the last fuel cut-off process after starting the internal combustion engine 10 is greater than or equal to a predetermined period Tth1 (S42). This process is implemented by counting the duration of the fuel cut-off process in advance when the fuel cut-off process M32 is executed. When the fuel cut-off process is not executed after the internal combustion engine 10 is started, the CPU 62 sets the duration to 0. When the CPU 62 determines that the fuel cut-off time is greater than or equal to the predetermined period Tth1 (S42: YES), the CPU 62 determines whether or not an integrated air amount, which is an integrated value of the intake air amount Ga after the execution of the fuel cut-off process is stopped (after fuel cut-off recovery), is less than a predetermined amount Inth1 (S44). The integrated air amount is a parameter having a positive correlation with the amount of fuel burned in the combustion chamber 24 after the fuel cut-off process is stopped. The predetermined amount Inth1 is set to a value that allows the temperature of the top surface 22*a* of the piston 22 to increase again to a temperature suitable for using the fourth map data set when the temperature of the top surface 22*a* is decreased through the fuel cut-off process. When the CPU 62 determines that the integrated air amount after the execution of the fuel cut-off process is stopped is less than the predetermined amount Inth1 (S44: YES), the CPU 62 determines whether or not the elapsed time after the fuel cut-off process is stopped is less than a predetermined period Tth2 (S46). The predetermined period Tth2 is set to a value that allows the temperature of the top surface 22*a* of the piston 22 to increase again to a temperature suitable for using the fourth map data set when the temperature of the top surface 22*a* is decreased through the fuel cut-off process.

When the CPU 62 determines that the elapsed time after the fuel cut-off process is stopped is less than the predetermined period Tth2 (S46: YES), the CPU 62 substitutes 1 for the second flag F2 (S48). When the CPU 62 makes negative determinations in the processes of S42, S44, and S46, the CPU 62 substitutes 0 for the second flag F2 (S50). In the present embodiment, when proceeding to step S48, each output variable dij of the fourth map data set is adapted to reduce PN even if the injection start timing Ainj calculated based on the fourth map data set is used. The difference between the injection start timing Ainj calculated based on the fourth map data set and an injection start timing at which the PN is excessively large is smaller when proceeding to step S48 than when proceeding to the process of S50.

When the CPU 62 completes the process of S48 or S50, the CPU 62 determines that the duration (idling execution) of executing the last idling process M14 after starting the internal combustion engine 10 is greater than or equal to a certain period Tth3 (S52). This process is a process for determining whether or not the temperature of the top surface 22*a* of the piston 22 decreases when the amount of heat generated in the combustion chamber 24 through the combustion stroke is reduced through the idling process M14.

When the CPU 62 determines that the idling duration is greater than or equal to the certain period Tth3 (S52: YES), the CPU 62 determines whether or not the integrated air amount after the idling process M14 is stopped (idling off) is less than a predetermined amount Inth2 (S54). The integrated air amount is a parameter having a positive correlation with the amount of fuel burned in the combustion chamber 24 after the idling process M14 is stopped. The predetermined amount Inth2 is set to a value that allows the temperature of the top surface 22*a* of the piston 22 to increase again to a temperature suitable for using the fourth map data set when the temperature of the top surface 22*a* is decreased through the idling process M14.

When the CPU 62 determines that the integrated air amount after the idling-off is less than the predetermined amount Inth2 (S54: YES), the CPU 62 determines whether or not the elapsed time after the idling process M14 is stopped (idling off) is less than a predetermined period Tth4 (S56). The predetermined period Tth4 is set to a value that allows the temperature of the top surface 22*a* of the piston 22 to increase again to a temperature suitable for using the fourth map data set when the temperature of the top surface 22*a* is decreased through the idling process M14.

When the CPU 62 determines that the elapsed time after the idling process M14 is stopped is less than the predetermined period Tth4 (S56: YES), the CPU 62 substitutes 1 for the third flag F3 (S58). When the CPU 62 makes negative determinations in the processes of S52, S54, and S56, the CPU 62 substitutes 0 for the third flag F3 (S60). In the present embodiment, when proceeding to step S58, as long as the duration of the idling process M14 is not excessively long, each output variable dij of the fourth map data set is adapted to reduce PN even if the injection start timing Ainj calculated based on the fourth map data set is used. The difference between the injection start timing Ainj calculated based on the fourth map data set and an injection start timing at which the PN is excessively large is smaller when proceeding to step S58 than when proceeding to the process of S60.

When the CPU 62 completes the process of S58 or S60, the CPU 62 ends the series of processes illustrated in FIG. 5.

The operation and advantages of the present embodiment will now be described.

After the internal combustion engine 10 is cold-started, the CPU 62 uses the first map data set to calculate the injection start timing Ainj and operate the direct injection valve 26 based on the calculated injection start timing Ainj. When the coolant temperature THW is greater than or equal to the cold-time threshold value THW1, the CPU 62 uses the second map data set to calculate the injection start timing Ainj and operate the direct injection valve 26 based on the calculated injection start timing Ainj. Subsequently, when the coolant temperature THW is greater than or equal to the preset temperature THW2, the CPU 62 switches the map data used to calculate the injection start timing Ainj from the second map data set to the third map data set or the fourth map data set. When the internal combustion engine 10 is cold-started, the lubricant temperature Toil tends to rise at a later timing than the coolant temperature THW. Thus, even if the coolant temperature THW is greater than or equal to the preset temperature THW2, the lubricant temperature Toil may remain a temperature at which the top surface 22*a* of the piston 22 is excessively cooled. If the fourth map data set is used to calculate the injection start timing Ainj even in such a case, the fuel injected from the direct injection valve 26 collects on the top surface 22*a* of the piston 22. This may promote atomization and additionally increase PN. Accordingly, when the lubricant temperature Toil is lower than the second predetermined temperature ToilH, the CPU 62 of the present embodiment uses the third map data set and thus reduces PN to a larger extent than when using, for example, the fourth map data set.

In the present embodiment, the OSV 54 can stop discharging lubricant from the injection nozzle 56 to the piston 22. However, when the temperature of the piston 22 is high, discharging lubricant needs to be ensured. Thus, for example, the estimation accuracy of the temperature of the piston 22 may make it difficult to stop discharging lubricant when the coolant temperature THW is greater than or equal to the preset temperature THW2. Accordingly, even if the lubricant temperature Toil does not sufficiently increase, discharging lubricant to the piston 22 may cause the piston 22 to be cooled by the lubricant. When a logic in which the fourth map data set is not used in such a case is set as a logic in which only the coolant temperature THW is referred to, the preset temperature THW2 needs to be a larger value than that of the present embodiment.

Correspondence

The correspondence between the matters in the above-described embodiment and the matters described in the section "SUMMARY" is as follows. Hereinafter, the correspondence relationship is shown for every number in the example described in the section "SUMMARY."

[1] The "fuel injection timing controller" corresponds to the controller 60. The "lubrication device" corresponds to the oil pump 52, the OSV 54, and the injection nozzle 56.

[2] The "advancement process" corresponds to the processes of S20 and S22. The "retardation process" corresponds to the process of S20.

[3] The "cold-time process" corresponds to the process of S12.

[4] Example 4 corresponds to the process of S20 when the second flag F2 is determined to be 1 in the process of S18.

[5] Example 5 corresponds to the process of S20 when the third flag F3 is determined to be 1 in the process of S18.

[6] The "storage device" corresponds to the ROM 64.

Other Embodiments

It should be apparent to those skilled in the art that the present disclosure may be embodied in many other specific forms without departing from the spirit or scope of the disclosure. Particularly, it should be understood that the present disclosure may be embodied in the following forms.

Advancement Process

In the above-described embodiment, the output variable cpq of the third map data set other than the region AR1 is set to a value having a larger advancement amount than the corresponding output variable bpq of the second map data set. Instead, for example, some of the output variables cpq other than the region AR1 may coincide with the corresponding output variables bpq. Alternatively, in all the regions including the region AR1, the output variable cij may be set to a value having a larger advancement amount than the corresponding output variable bij. As another option, in all the regions including the region AR1, the output variable cij may be set to be greater than or equal to the corresponding output variable bij. In this case, the output variable cij may have a larger advancement amount than the output variable bij.

In the above-described embodiment, the output variable dpq of the fourth map data set other than the region AR1 is set to a value having a larger advancement amount than the corresponding output variable bpq of the second map data set. Instead, for example, some of the output variables dpq other than the region AR1 may coincide with the corresponding output variables bpq. Alternatively, in all the regions including the region AR1, the output variable dij may be set to a value having a larger advancement amount than the corresponding output variable bij. As another option, in all the regions including the region AR1, the output variable dij may be set to be greater than or equal to the corresponding output variable bij. In this case, the output variable dij may have a larger advancement amount than the output variable bij.

In the above-described embodiment, the difference between the region in which the output variable cij has a larger advancement amount than the corresponding output variable bij and the region in which the output variable dij has a larger advancement amount than the corresponding output variable bij is not defined. Instead, for example, the region in which the output variable cij has a larger advancement amount than the corresponding output variable bij may be broader than the region in which the output variable dij has a larger advancement amount than the corresponding output variable bij.

Retardation Process

In the above-described embodiment, in all the regions, the output variable dij of the fourth map data set has a larger advancement amount than the corresponding output variable cij of the third map data set. Instead, for example, some of the output variables dij may be equal to the corresponding output variables cij.

In the above-described embodiment, the retardation process is executed when the logical disjunction of conditions (i) to (iii) is true. Instead, for example, the retardation process may be executed when the logical disjunction of conditions (i) and (ii) is true or when the logical disjunction of conditions (i) and (iii) is true. Alternatively, for example, the retardation process may be executed depending on whether or not condition (i) is satisfied.

Start Timing Setting Process

In the above-described embodiment, in all the regions, the output variable cij of the third map data set is set so that the output variable cok having a high rotation speed NE is greater than or equal to the output variable clk having a low rotation speed NE and the output variable cko having a high charging efficiency η is greater than or equal to the output variable ckl having a low charging efficiency η. Instead, for example, the output variable cij of the third map data set may be so that the output variable cok having a high rotation speed NE is greater than or equal to the output variable clk having a low rotation speed NE in all the regions and the output variable cko having a high charging efficiency η is not greater than or equal to the output variable ckl having a low charging efficiency η in some regions. Alternatively, the output variable cij of the third map data set may be so that the output variable cko having a high charging efficiency η is greater than or equal to the output variable ckl having a low charging efficiency η in all the regions and the output variable cok having a high rotation speed NE is not greater than or equal to the output variable clk having a low rotation speed NE in some regions. As another option, only in low-load regions, the output variable cij of the third map data set may be so that the output variable cok having a high rotation speed NE is not necessarily greater than or equal to the output variable clk having a low rotation speed NE and the output variable cko having a high charging efficiency η is not necessarily greater than or equal to the output variable ckl having a low charging efficiency η.

In the above-described embodiment, in all the regions, the output variable dij of the fourth map data set is set so that the output variable dok having a high rotation speed NE is greater than or equal to the output variable dlk having a low rotation speed NE and the output variable dko having a high charging efficiency η is greater than or equal to the output variable dkl having a low charging efficiency r. Instead, for example, the output variable dij of the third map data set may be so that the output variable dok having a high rotation speed NE is greater than or equal to the output variable dlk having a low rotation speed NE in all the regions and the output variable dko having a high charging efficiency η is not greater than or equal to the output variable dkl having a low charging efficiency η in some regions. Alternatively, the output variable dij of the third map data set may be so that the output variable dko having a high charging efficiency η is greater than or equal to the output variable dkl having a low charging efficiency η in all the regions and the output variable dok having a high rotation speed NE is not greater than or equal to the output variable dlk having a low rotation speed NE in some regions. As another option, only in low-load regions, the output variable dij of the third map data set may be so that the output variable dok having a high rotation speed NE is not necessarily greater than or equal to the output variable dlk having a low rotation speed NE and the output variable dko having a high charging efficiency η is not necessarily greater than or equal to the output variable dkl having a low charging efficiency η.

In the above-described embodiment, the output variable bij of the second map data set is set so that the output variable bko having a high charging efficiency η is greater than or equal to the output variable bkl having a low charging efficiency η in all the regions and the output variable bok having a high rotation speed NE is greater than or equal to the output variable blk having a low rotation speed NE excluding the region AR2. Instead, in all the regions, the output variable bij of the second map data set may be so that the output variable bok having a high rotation speed NE is greater than or equal to the output variable blk having a low rotation speed NE and the output variable bko having a high charging efficiency η is greater than or equal to the output variable bkl having a low charging efficiency f. Alternatively, the output variable bij of the second map data set may be so that the output variable bok having a high rotation speed NE is greater than or equal to the output variable blk having a low rotation speed NE in all the regions and the output variable bko having a high charging efficiency η is not greater than or equal to the output variable bkl having a low charging efficiency η in some regions.

In the above-described embodiment, the CPU 62 selects the second map data set, the third map data set, or the fourth map data set depending on whether or not the coolant temperature THW is greater than or equal to the preset temperature THW2. Instead, for example, when the coolant temperature THW is greater than or equal to a second preset temperature, the CPU 62 may switch the second map data set to the third map data set or the fourth map data set. Alternatively, when the coolant temperature THW is greater than or equal to a first preset temperature, which is lower than the second preset temperature, the CPU 62 may switch the third map data set or the fourth map data set to the second map data set.

The above-described embodiment includes four map data sets as the map data sets used to set the injection start timing Ainj based on the coolant temperature THW and the like. Instead, for example, a temperature region in which the coolant temperature THW is greater than or equal to the cold-time threshold value THW1 and lower than the preset temperature THW2 may be divided into multiple temperature regions each including a map data set. In this case, these map data sets simply need to be set so that the value of the output variable at each operating point in a temperature region having a high coolant temperature THW is greater than or equal to the value of the output variable at the corresponding operating point in a temperature region having a lower coolant temperature THW. Also, at some operating points, these map data sets simply need to be set so that the value of the output variable in a temperature region having a high coolant temperature THW is a value having a larger advancement amount than the value of the output variable in a temperature region having a low coolant temperature THW.

The map data set may have other input variables in addition to the rotation speed NE and the charging efficiency η. Alternatively, only one of the rotation speed NE and the charging efficiency η may be an input variable.

In addition, the parameter indicating the load of the internal combustion engine 10 is not limited to the charging efficiency η and may be the base injection amount Qb or the request injection amount Qd.

The map data sets do not have to be used. Instead, for example, the rotation speed NE and the charging efficiency η may be treated as independent variables, and the injection start timing Ainj may be calculated based on functional data in which the injection start timing is a dependent variable.

Preset Temperature, Predetermined Temperature

In the above-described embodiment, the preset temperature THW2 is higher than the increase threshold value THWf. Instead, the preset temperature THW2 may be equal to the increase threshold value THWf.

In the above-described embodiment, the first predetermined temperature ToilL and the second predetermined temperature ToilH are set. Instead, a single predetermined temperature may be set. In this case, the single predetermined temperature may be higher than the preset temperature THW2. Alternatively, the single predetermined temperature may be equal to the preset temperature.

In the above-described embodiment, the preset temperature THW2 is lower than the second predetermined temperature ToilH. Instead, for example, as described in the section "Start Timing Setting Process," when the first preset temperature and the second preset temperature are set, the second preset temperature may be lower than the second predetermined temperature ToilH and the first preset temperature may be lower than the first predetermined temperature ToilL. Alternatively, the second preset temperature may be equal to the second predetermined temperature ToilH.

Second Flag F2

In the above-described embodiment, the condition for setting the second flag F2 to 1 is that the logical conjunction of the condition that the integrated air amount is less than the predetermined amount Inth1 in the process of S44 and the condition that the elapsed time is less than the predetermined period Tth2 in the process of S46 is true. Instead, for example, the condition for setting the second flag F2 to 1 may be that the logical disjunction of these two conditions is true. Alternatively, any one of the processes of S44 and S46 may be deleted.

In the above-described embodiment, when the second flag F2 is 1, the injection start timing Ainj is set to reduce the difference between the injection start timing at which PN increases and the injection start timing Ainj. Instead, for example, the injection start timing Ainj may be set to reduce PN. This is effective, for example, when setting the second predetermined temperature ToilH to be lower.

Third Flag F3

In the above-described embodiment, the condition for setting the third flag F3 to 1 is that the logical conjunction of the condition that the integrated air amount is less than the predetermined amount Inth2 in the process of S54 and the condition that the elapsed time is less than the predetermined period Tth4 in the process of S56 is true. Instead, for example, the condition for setting the third flag F3 to 1 may be that the logical disjunction of these two conditions is true. Alternatively, any one of the processes of S54 and S56 may be deleted.

In the above-described embodiment, when the third flag F3 is 1, the injection start timing Ainj is set to reduce the difference between the injection start timing at which PN increases and the injection start timing Ainj. Instead, for example, the injection start timing Ainj may be set to reduce PN. This is effective for, for example, when setting the second predetermined temperature ToilH to be lower.

As described in the section "Idling Process," when fuel is injected from the direct injection valve 26 during the idling process, for example, it is desired that the following change be made. That is, it is desired that the duration of an idling process that is being currently performed be added to the process of S52. Alternatively, instead of the process of S54, it is desired that the CPU 62 determine whether or not the logical disjunction of the condition that idling is being performed and the condition that the integrated air amount is smaller than the predetermined amount Inth2 is true. As another option, instead of the process of S56, it is desired that the CPU 62 determine whether or not the logical disjunction of the condition that idling is being performed and the condition that the elapsed time is shorter than the predetermined period Tth4 is true.

Idling Process

In the above-described embodiment, when the idling process M14 is executed, fuel is injected by the port injection valve 17. However, fuel injection does not have to be performed in this manner.

Fuel Injection Using Direction Injection Valve

In the above-described embodiment, with regard to the fuel injection using the direct injection valve 26, the specification does not describe how many times fuel injection is performed in a single cylinder in one combustion cycle. Fuel injection may be performed once or may be performed a number of times. When fuel injection is performed a number of times, the setting of the injection start timing Ainj shown as an example in the above-described embodiment is performed as a process for setting the injection start timing of the first fuel injection.

Lubrication Device

The above-described structure includes the OSV 54. The OSV 54 is configured to stop discharging lubricant from the injection nozzle 56 to the piston 22 even when the crankshaft 30 is rotating. Instead, the above-described structure may include an oil control valve (OCV) capable of continuously adjusting the discharge amount of lubricant. Alternatively, this OSV or the OSV 54 does not have to be provided. In this case, while the crankshaft 30 is rotating, the amount of lubricant discharged from the injection nozzle 56 to the piston 22 cannot be reduced.

Fuel Injection Timing Controller

The fuel injection timing controller does not have to include the CPU 62 and the ROM 64 to execute software processing. For example, at least part of the processes executed by the software in the above-described embodiment may be executed by hardware circuits dedicated to executing these processes (such as ASIC). That is, the fuel injection timing controller may be modified as long as it has any one of the following configurations (a) to (c). (a) A configuration including a processor that executes all of the above-described processes according to programs and a program storage device such as a ROM (including a non-transitory computer readable medium) that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

Storage Device

The storage device that stores map data sets does not have to be the ROM 64, which stores the programs executed by the CPU 62. Instead, for example, a storage device that differs from the program storage device that stores the programs may be used.

Internal Combustion Engine

The internal combustion engine does not have to include the forced induction device 14 and the port injection valve 17. The request injection amount Qd does not have to be obtained by correcting the base injection amount Qb with the correction coefficient K. Instead, for example, the request injection amount may be obtained by correcting the base injection amount Qb with an operation amount used to perform feedback control for the detection value of an air-fuel ratio to a target value.

Therefore, the present examples and embodiments are to be considered as illustrative and not restrictive and the disclosure is not to be limited to the details given herein, but may be modified within the scope and equivalence of the appended claims.

The invention claimed is:

1. A controller for an internal combustion engine, the controller comprising a processor that controls a fuel injection timing of the internal combustion engine, the internal combustion engine including a direct injection valve that injects fuel into a combustion chamber and a lubrication device that discharges lubricant toward a rear surface of a piston, wherein the processor is configured to execute a start timing setting process for setting, through at least one of two processes, an injection start timing of fuel by the direct injection valve, wherein one of the two processes is a process for setting the injection start timing to be more advanced when a rotation speed of a crankshaft of the internal combustion engine is high than when the rotation speed is low, and the other one of the two processes is a process for setting the injection start timing to be more advanced when a load on the internal combustion engine is large than when the load is small, and an injection valve operation process for operating the direct injection valve in order to start injecting fuel from the direct injection valve at the injection start timing, the start timing setting process includes an advancement process for advancing the injection start timing to a larger extent when a coolant temperature that is a temperature of coolant in the internal combustion engine is greater than or equal to a preset temperature than when the coolant temperature is lower than the preset temperature, and the advancement process includes a retardation process, wherein in a case in which the coolant temperature is greater than or equal to the preset temperature, the retardation process sets a smaller advancement amount at the injection start timing when a lubricant temperature that is a temperature of the lubricant is lower than a predetermined temperature than when the lubricant temperature is greater than or equal to the predetermined temperature.

2. The controller according to claim 1, wherein the processor is configured to execute, when the coolant temperature is lower than or equal to an increase threshold value, a low-temperature fuel-increasing process for increasing an amount of fuel supplied to the combustion chamber in a single combustion cycle to a larger extent when the coolant temperature is low than when the coolant temperature is high, and the preset temperature is a value greater than or equal to the increase threshold value.

3. The controller according to claim 1, wherein the start timing setting process includes a cold-time process, wherein when the coolant temperature is less than a cold-time threshold value that is less than the preset temperature, the cold-time process advances the injection start timing to a larger extent than when the coolant temperature is greater than or equal to the cold-time threshold value, and in a case in which the coolant temperature is greater than or equal to the preset temperature, the advancement process advances the injection start timing to a larger extent, in a range in which the injection start timing is not set to be more advanced than when the coolant temperature is less than the cold-time threshold value, than when the coolant temperature is lower than or equal to the preset temperature and greater than or equal to the cold-time threshold value.

4. The controller according to claim 1, wherein the processor is configured to execute a fuel cut-off process for stopping supplying fuel to the combustion chamber, and the retardation process includes a process for setting a small advancement amount at the injection start timing in the same manner as a case in which the coolant temperature is greater than or equal to the preset temperature and the lubricant temperature is lower than the predetermined temperature on condition that the fuel cut-off process has been continued for a predetermined period even if the coolant temperature is greater than or equal to the preset temperature and the lubricant temperature is greater than or equal to the predetermined temperature.

5. The controller according to claim 1, wherein the processor is configured to execute an idling process for controlling the rotation speed of the crankshaft to a target rotation speed on condition that an accelerator operation amount is zero, and the retardation process includes a process for setting a small advancement amount at the injection start timing in the same manner as a case in which the coolant temperature is greater than or equal to the preset temperature and the lubricant temperature is lower than the predetermined temperature on condition that the idling process has been continued for a certain period even if the coolant temperature is greater than or equal to the preset temperature and the lubricant temperature is greater than or equal to the predetermined temperature.

6. The controller according to claim 1, further comprising a storage device that stores map data sets, the map data sets each including the rotation speed and the load as an input variable and including the injection start timing as an output variable, wherein the map data sets include a map data set selected when the coolant temperature is lower than the preset temperature, a map data set selected when the coolant temperature is greater than or equal to the preset temperature and the lubricant temperature is lower than the predetermined temperature, and a map data set selected when the coolant temperature is greater than or equal to the preset temperature and the lubricant temperature is greater than or equal to the predetermined temperature, and the start timing setting process includes a process for setting the injection start timing using the map data sets.

7. A control method for controlling a fuel injection timing of an internal combustion engine, wherein the internal combustion engine includes a direct injection valve that injects fuel into a combustion chamber and a lubrication device that discharges lubricant toward a rear surface of a piston, the control method comprising:

setting, through at least one of two processes, an injection start timing of fuel by the direct injection valve, wherein one of the two processes is a process for setting the injection start timing to be more advanced when a rotation speed of a crankshaft of the internal combustion engine is high than when the rotation speed is low, and the other one of the two processes is a process for setting the injection start timing to be more advanced when a load on the internal combustion engine is large than when the load is small; and operating the direct injection valve in order to start injecting fuel from the direct injection valve at the injection start timing, the control method further comprising:

advancing the injection start timing to a larger extent when a coolant temperature that is a temperature of coolant in the internal combustion engine is greater than or equal to a preset temperature than when the coolant temperature is lower than the preset temperature; and setting, in a case in which the coolant temperature is greater than or equal to the preset temperature, a smaller advancement amount at the injection start timing when a lubricant temperature that is a temperature of the lubricant is lower than a predetermined temperature than when the lubricant temperature is greater than or equal to the predetermined temperature.

8. A non-transitory computer-readable storage medium that stores a program causing a processor to execute a control process for controlling a fuel injection timing of an internal combustion engine, wherein the internal combustion engine includes a direct injection valve that injects fuel into a combustion chamber and a lubrication device that discharges lubricant toward a rear surface of a piston, the control process comprising:

setting, through at least one of two processes, an injection start timing of fuel by the direct injection valve, wherein one of the two processes is a process for setting the injection start timing to be more advanced when a rotation speed of a crankshaft of the internal combustion engine is high than when the rotation speed is low, and the other one of the two processes is a process for setting the injection start timing to be more advanced when a load on the internal combustion engine is large than when the load is small; and operating the direct injection valve in order to start injecting fuel from the direct injection valve at the injection start timing;

the control process further comprising:

advancing the injection start timing to a larger extent when a coolant temperature that is a temperature of coolant in the internal combustion engine is greater than or equal to a preset temperature than when the coolant temperature is lower than the preset temperature; and setting, in a case in which the coolant temperature is greater than or equal to the preset temperature, a smaller advancement amount at the injection start timing when a lubricant temperature that is a temperature of the lubricant is lower than a predetermined temperature than when the lubricant temperature is greater than or equal to the predetermined temperature.

* * * * *